US007310493B2

(12) United States Patent
Roof et al.

(10) Patent No.: US 7,310,493 B2
(45) Date of Patent: Dec. 18, 2007

(54) MULTI-UNIT GLOSSING SUBSYSTEM FOR A PRINTING DEVICE

(75) Inventors: Bryan J. Roof, Fairport, NY (US); Gerald M. Fletcher, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 131 days.

(21) Appl. No.: 11/166,460

(22) Filed: Jun. 24, 2005

(65) Prior Publication Data

US 2006/0291927 A1 Dec. 28, 2006

(51) Int. Cl.
*G03G 15/20* (2006.01)

(52) U.S. Cl. ..... 399/341

(58) Field of Classification Search ..... 399/1–3, 399/322, 328, 329, 341
See application file for complete search history.

(56) References Cited

U.S. PATENT DOCUMENTS

| | | | | |
|---|---|---|---|---|
| 4,579,446 | A | 4/1986 | Fujino et al. | |
| 4,587,532 | A | 5/1986 | Asano | |
| 4,836,119 | A | 6/1989 | Siraco et al. | |
| 5,004,222 | A | 4/1991 | Dobashi | |
| 5,080,340 | A | 1/1992 | Hacknauer et al. | |
| 5,095,342 | A | 3/1992 | Farrell et al. | |
| 5,159,395 | A | 10/1992 | Farrell et al. | |
| 5,208,640 | A | 5/1993 | Horie et al. | |
| 5,272,511 | A | 12/1993 | Conrad et al. | |
| 5,326,093 | A | 7/1994 | Sollitt | |
| 5,435,544 | A | 7/1995 | Mandel | |
| 5,473,419 | A | 12/1995 | Russel et al. | |
| 5,489,969 | A | 2/1996 | Soler et al. | |
| 5,504,568 | A | 4/1996 | Saraswat et al. | |
| 5,525,031 | A | 6/1996 | Fox | |
| 5,557,367 | A | 9/1996 | Yang et al. | |
| 5,568,246 | A | 10/1996 | Keller et al. | |
| 5,570,172 | A | 10/1996 | Acquaviva | |
| 5,596,416 | A | 1/1997 | Barry et al. | |
| 5,629,762 | A | 5/1997 | Mahoney et al. | |
| 5,710,968 | A | 1/1998 | Clark et al. | |
| 5,778,377 | A | 7/1998 | Marlin et al. | |
| 5,884,910 | A | 3/1999 | Mandel | |
| 5,887,234 | A * | 3/1999 | Aslam et al. | 399/322 |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |

(Continued)

OTHER PUBLICATIONS

Morgan, P.F., "Integration of Black Only and Color Printers", Xerox Disclosure Journal, vol. 16, No. 6. Nov./Dec. 1991, pp. 381-383.

(Continued)

*Primary Examiner*—William J. Royer
(74) *Attorney, Agent, or Firm*—Eugene O. Palazzo; Faye Sharpe LLP

(57) ABSTRACT

A glossing subsystem is provided that receives duplexed output media that has been selectively marked on a first side and a second side. The glossing subsystem includes: a first glossing unit that selectively provides a first gloss level to a first side of the duplexed output media; and, a second glossing unit that selectively provides a second gloss level to a second side of the duplexed output media.

17 Claims, 2 Drawing Sheets

U.S. PATENT DOCUMENTS

| | | | | |
|---|---|---|---|---|
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,487,388 | B2 | 11/2002 | Theodoulou et al. | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,687,483 | B2 * | 2/2004 | Chen et al. | 399/341 |
| 6,819,906 | B1 | 11/2004 | Herrmann et al. | |
| 6,980,762 | B2 * | 12/2005 | Bogoshian | 399/328 |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel, et al.
U.S. Appl. No. 10/785,211, filed Feb. 24, 2004, Lofthus, et al.
U.S. Appl. No. 10/881,619, filed Jun. 30, 2004, Bobrow.
U.S. Appl. No. 10/917,676, filed Aug. 13, 2004, Lofthus, et al.
U.S. Appl. No. 10/917,768, filed Aug. 13, 2004, Lofthus, et al.
U.S. Appl. No. 10/924,106, filed Aug. 23, 2004, Lofthus, et al.
U.S. Appl. No. 10/924,113, filed Aug. 23, 2004, deJong, et al.
U.S. Appl. No. 10/924,458, filed Aug. 23, 2004, Lofthus, et al.
U.S. Appl. No. 10/924,459, filed Aug. 23, 2004, Mandel, et al.
U.S. Appl. No. 10/933,556, filed Sep. 3, 2004, Spencer, et al.
U.S. Appl. No. 10/953,953, filed Sep. 29, 2004, Radulski, et al.
U.S. Appl. No. 10/999,326, filed Nov. 30, 2004, Grace, et al.
U.S. Appl. No. 10/999,450, filed Nov. 30, 2004, Lofthus, et al.
U.S. Appl. No. 11/000,158, filed Nov. 30, 2004, Roof.
U.S. Appl. No. 11/000,168, filed Nov. 30, 2004, Biegelsen, et al.
U.S. Appl. No. 11/000,258, filed Nov. 30, 2004, Roof.
U.S. Appl. No. 11/001,890, filed Dec. 2, 2004, Lofthus, et al.
U.S. Appl. No. 11/002,528, filed Dec. 2, 2004, Lofthus, et al.
U.S. Appl. No. 11/051,817, filed Feb. 4, 2005, Moore, et al.
U.S. Appl. No. 11/070,681, filed Mar. 2, 2005, Viturro, et al.
U.S. Appl. No. 11/081,473, filed Mar. 16, 2005, Moore.
U.S. Appl. No. 11/069,020, filed Feb. 28, 2005, Lofthus, et al.
U.S. Appl. No. 11/089,854, filed Mar. 25, 2005, Clark, et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore, et al.
U.S. Appl. No. 11/094,998, filed Mar. 31, 2005, Moore, et al.
U.S. Appl. No. 11/094,864, filed Mar. 31, 2005, de Jong, et al.
U.S. Appl. No. 11/095,872, filed Mar. 31, 2005, Julien, et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel, et al.
U.S. Appl. No. 11/109,558, filed Apr. 19, 2005, Furst, et al.
U.S. Appl. No. 11/109,996, filed Apr. 20, 2005, Mongeon, et al.
U.S. Appl. No. 11/093,229, filed Mar. 29, 2005, Julien.
U.S. Appl. No. 11/102,899, filed Apr. 8, 2005, Crawford, et al.
U.S. Appl. No. 11/102,910, filed Apr. 8, 2005, Crawford, et al.
U.S. Appl. No. 11/115,766, filed Apr. 27, 2005, Grace.
U.S. Appl. No. 11/102,332, filed Apr. 8, 2005, Hindi, et al.
U.S. Appl. No. 11/136,959, filed May 25, 2005, German, et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus, et al.
U.S. Appl. No. 11/137,251, filed May 25, 2005, Lofthus, et al.
U.S. Appl. No. 11/137,273, filed May 25, 2005, Anderson, et al.

* cited by examiner

MULTI-UNIT GLOSSING SUBSYSTEM FOR A PRINTING DEVICE

BACKGROUND

The present disclosure relates to the printing arts. More specifically, it relates to a glossing subsystem for a printing device or machine. It finds particular application in conjunction with duplex printing on xerographic devices or machines having multiple Integrated Marking Engines (IMEs), and will be described with particular reference thereto. However, one of ordinary skill in the art will appreciate that it is also amenable to other like applications.

In general, xerographic printing devices are known which employ a plurality of IMEs. Examples can be found in the references cited below under the CROSS REFERENCE TO RELATED PATENTS AND APPLICATIONS heading. One issue encountered in such devices is controlling gloss uniformity across multiple IMEs. That is to say, the particular characteristics of the different IMEs employed can result in each IME providing a different level of gloss to their respective outputs. Various approaches have been developed to address this concern. For example, U.S. application Ser. Nos. 11/000,158 and 11/000,258, both filed Nov. 30, 2004, describe a calibration system for maintaining a uniform gloss characteristic between printed images generated by different IMEs within the same printing device.

However, other issues can also be encountered with fusers of the type typically employed in xerographic printing devices. Generally, it is desired that the printed sheets or other media being output have a suitable level of image permanence (i.e., fix) and image appearance (i.e., gloss). Fix and gloss criteria influence fuser design and/or fuser choice as well as fuser operating conditions, e.g., the amount of heat and/or pressure applied. These factors, in turn, influence fuser life, which can introduce a significant reliability issue. For example, the reliability of color fusers is normally very low when compared with the rest of the machine and/or to black and white fusers. A substantial reason for this is the sensitivity of color images to a perceived degradation in quality due to non-uniform and/or inadequate gloss. Accordingly, higher temperatures and/or nip dwell times are typically employed to achieve the desired gloss, and this can adversely impact fuser life. Moreover, excessive wear may introduce and/or exacerbate other undesirable consequences, e.g., gloss non-uniformities across the length of the fuser or otherwise.

Multiple IME printing machines have multiple fusers and so the relatively low reliability of color fusers can be a significant concern, as well as gloss uniformity between distinct IMEs. Again, various approaches have been developed to address these concerns. For example, U.S. Provisional Patent Application Ser. Nos. 60/631,918 and 60/631,921, both filed Nov. 30, 2004, describe a Final Appearance and Permanence (FAP) module that reduces the load and/or design/operating restrictions on the fusers located within the IMEs by assuming or otherwise taking over to some degree the responsibility for glossing and/or optionally a portion of the responsibility for fixing. Additionally, insomuch as the same FAP or glossing subsystem is responsible for all the glossing operations, it addresses the problem of non-uniform glossing performed by different IMEs within the same printing device.

Notwithstanding the aforementioned solutions, it remains desirable to provide duplex printing operations in an efficient manner while continuing to address the concerns raised. Accordingly, a new and improved glossing subsystem and/or method are disclosed that overcome the above-referenced problems and others.

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES," by Barry P. Mandel, et al;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. Dejong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst et al.;

U.S. application Ser. No. 11/109,566, filed Apr. 19, 2005, entitled "MEDIA TRANSPORT SYSTEM," by Mandel et al.;

U.S. application Ser. No. 11/109,996, filed Apr. 20, 2005, entitled "PRINTING SYSTEMS," by Michael C. Mongeon et al.;

U.S. application Ser. No. 11/115,766, filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,821, filed May 25, 2005, entitled "AUTOMATED PROMOTION OF MONOCHROME JOBS FOR HLC PRODUCTION PRINTERS," by David C. Robinson;

U.S. application Ser. No. 11/136,959, filed May 25, 2005, entitled,"PRINTING SYSTEMS", by Kristine A. German et al.;

U.S. application Ser. No. 11/137,634, filed May 25, 2005, entitled "PRINTING SYSTEM", by Robert M. Lofthus et al.;

U.S. application Ser. No. 11/137,251, filed May 25, 2005, entitled "SCHEDULING SYSTEM", by Robert M. Lofthus et al.;

U.S. application Ser. No. 11/137,273, filed May 25, 2005, entitled "PRINTING SYSTEM", by David G. Anderson et al.;

U.S. application Ser. No. 11/143,818, filed Jun. 2, 2005, entitled "INTER-SEPARATION DECORRELATOR", by Edul N. Dalal et al.;

U.S. application Ser. No. 11/146,665, filed Jun. 7, 2005, entitled "LOW COST ADJUSTMENT METHOD FOR PRINTING SYSTEMS", by Michael C. Mongeon; and, U.S. application Ser. No. 11/152,275, filed Jun. 14, 2005, entitled "WARM-UP OF MULTIPLE INTEGRATED MARKING ENGINES", by Bryan J. Roof et al.

BRIEF DESCRIPTION

In one exemplary embodiment of the present inventive subject matter, a printing device includes: a plurality of marking engines that selectively place marks on an output media having opposing first and second sides using a marking agent deposited on the output media, each marking engine including a fuser that at least temporarily fixes the marking agent to the output media; and, a glossing subsystem that receives marked output media from the marking engines, the glossing subsystem including a first glossing unit that selectively provides a gloss level to the first side of the received output media and a second glossing unit that selectively provides a gloss level to the second side of the received output media.

In another embodiment, a xerographic imaging device includes: a first integrated marking engine, the first integrated marking engine selectively putting marks on an output media with a marking agent; a second integrated marking engine, the second integrated marking engine selectively putting marks on an output media with a marking agent; and, a glossing subsystem that receives marked output media from the first and second integrated marking engines, the glossing subsystem including a first glossing unit that selectively provides a gloss level to a first side of the received output media and a second glossing unit that selectively provides a gloss level to a second side of the received output media, the second side being opposite the first side.

In yet another embodiment, a glossing subsystem is provided that receives duplexed output media that has been selectively marked on a first side and a second side. The glossing subsystem includes: a first glossing unit that selectively provides a first gloss level to a first side of the duplexed output media; and, a second glossing unit that selectively provides a second gloss level to a second side of the duplexed output media.

BRIEF DESCRIPTION OF THE DRAWINGS

The subject matter of the present disclosure may take form in various components and arrangements of components, and in various steps and arrangements of steps. The drawings are only for purposes of illustrating preferred embodiments and are not to be construed as limiting. Further, it is to be appreciated that the drawings are not to scale.

DETAILED DESCRIPTION

Figure 1:
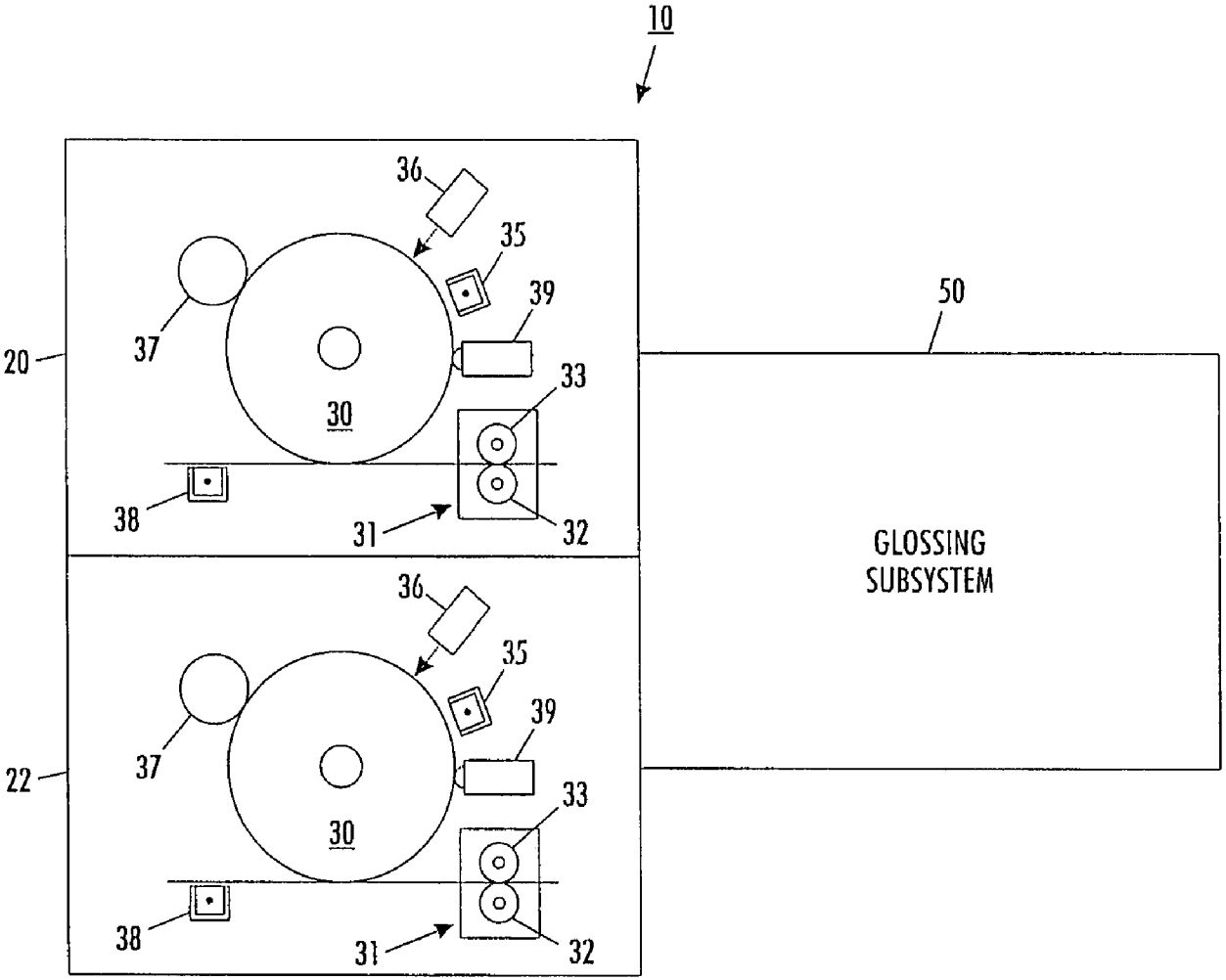
FIG. 1 is a schematic view of a printing device with multiple integrated IMEs and a glossing subsystem suitable for practicing aspects of the present inventive subject matter.

With reference to FIG. 1, an imaging and/or printing device 10 includes multiple IMEs. As illustrated, the printing device 10 includes two IMEs, namely, a first IME 20 and a second IME 22. While only two IMEs are shown for simplicity and clarity herein, optionally, the printing device 10 may include more than two IMEs. Suitably, the printing device 10 is a copier, a printer, a facsimile machine, a multi-function device or other like imaging and/or printing device, and the IMEs are implemented as xerographic or other like electrostatographic imaging and/or printing modules that image, print or otherwise place marks on an output media, such as a sheet of paper, to form a desired image thereon. As shown, each IME is equipped in the usual manner, e.g., with: a photoreceptor 30; a fusing station 31; a charging station 35; an exposing station 36 (e.g., including a raster output scanner (ROS) or other like exposure equipment); a developing station 37 (e.g., in a color embodiment, including multiple developer units, i.e., one for each color of toner or other marking agent to be developed); a transfer station 38; and, a cleaning station 39. Alternately, the multiple IMEs may be implemented in any customary manner. For example, in one alternate embodiment, the printing device 10 is a solid ink printing device in which the IMEs 20 and 22 are optionally implemented as print-heads and/or solid ink printing modules which use melted solid ink to selectively place marks on an output media.

Suitably, as is known in the art, each IME employs the photoreceptor 30 to produce or reproduce an image on the output media. For example, the photoreceptor 30 is constructed of a photoconductive layer arranged over an electrically conductive substrate. In response to light exposure, the photoconductive layer acts as an electrical conductor or as an electrical insulator. As shown, the photoreceptor 30 takes the shape of a cylindrical drum, but alternately, it may be a belt type photoreceptor or take another suitable form. Suitably, a motor (not shown) engages with the drum for rotating the drum to advance successive portions of the photoconductive surface through the various processing stations disposed about the photoreceptor 30.

At the charging station 35, the photoreceptor 30 is prepared to receive a latent image thereon by a charging process wherein a substantially uniform electrical charge is induced on the photoreceptor surface by a charging device, e.g., a corotron, scorotron, dicorotron, bias charge roll (BCR), and the like. At the exposing station 36, the latent image is formed on the charged photoreceptor 30 by projecting onto it a pattern of light corresponding to the desired image being formed. In accordance with the light pattern to which the photoreceptor 30 was exposed, the charge on the surface of the photoreceptor 30 is selectively discharged or altered such that the latent image is formed and/or represented by the electrostatic difference or variation across the surface of the photoreceptor 30. Suitably, at the developing station 37, an electrically charged toner or other marking agent is applied to the photoreceptor 30 containing the latent electrostatic image, thereby developing a visible toner image on the surface of the photoreceptor 30. The toner image is eventually transferred (at the transfer station 38) and fused (at the fusing station 31) to the output media. Suitably, after the transferring and fusing processes, any excess toner remaining on the photoreceptor 30 is removed at the cleaning station 39 so that the photoreceptor 30 is again ready for charging.

As illustrated, the fusing station 31 includes a fuser 32 and a pressure roll 33. Suitably, the fuser 32 takes the form of a roll that is heated by a heating element (not shown). When the output media with dry toner particles thereon moves between the two rollers 32 and 33, the pressure roller 33 presses the output media against the fuser 32. As is known in the art, the heat of the fuser 32 and pressure applied by the pressure roller 33 melts the toner and fuses it to the media. Alternately, the fusing station 31 may be implemented in any customary manner.

Optionally, as described in U.S. Provisional Application Ser. Nos. 60/631,918 and 60/631,921, the IMEs 20 and 22 and/or their fusing stations 31 are operated at or under conditions that achieve so called "in situ permanence" of the toner or other marking agent. That is to say, when the output media exits a particular IME, it does not yet have its "final" level of image permanence and/or image appearance. Rather, operating conditions (e.g., heat and/or pressure) employed in the fusing station 31 are selected or otherwise regulated to provide enough "fix" so that the image on the output media is preserved as it travels throughout the printing device 10. Optionally, in situ permanence, or "tacking of the image to the media" may be achieved in the individual IMEs by the application of pressure alone (i.e., without heat). Suitably, before the output media exits the printing device 10, it is provided the final level of fix and gloss, referred to as "archival permanence" and "final appearance", respectively, by a separate FAP module and/or glossing subsystem 50. In one exemplary embodiment, a suitable level of archival permanence is achieved at the fusing station 31, while the glossing subsystem 50 merely provides the final appearance or glossing operation.

Figure 2:
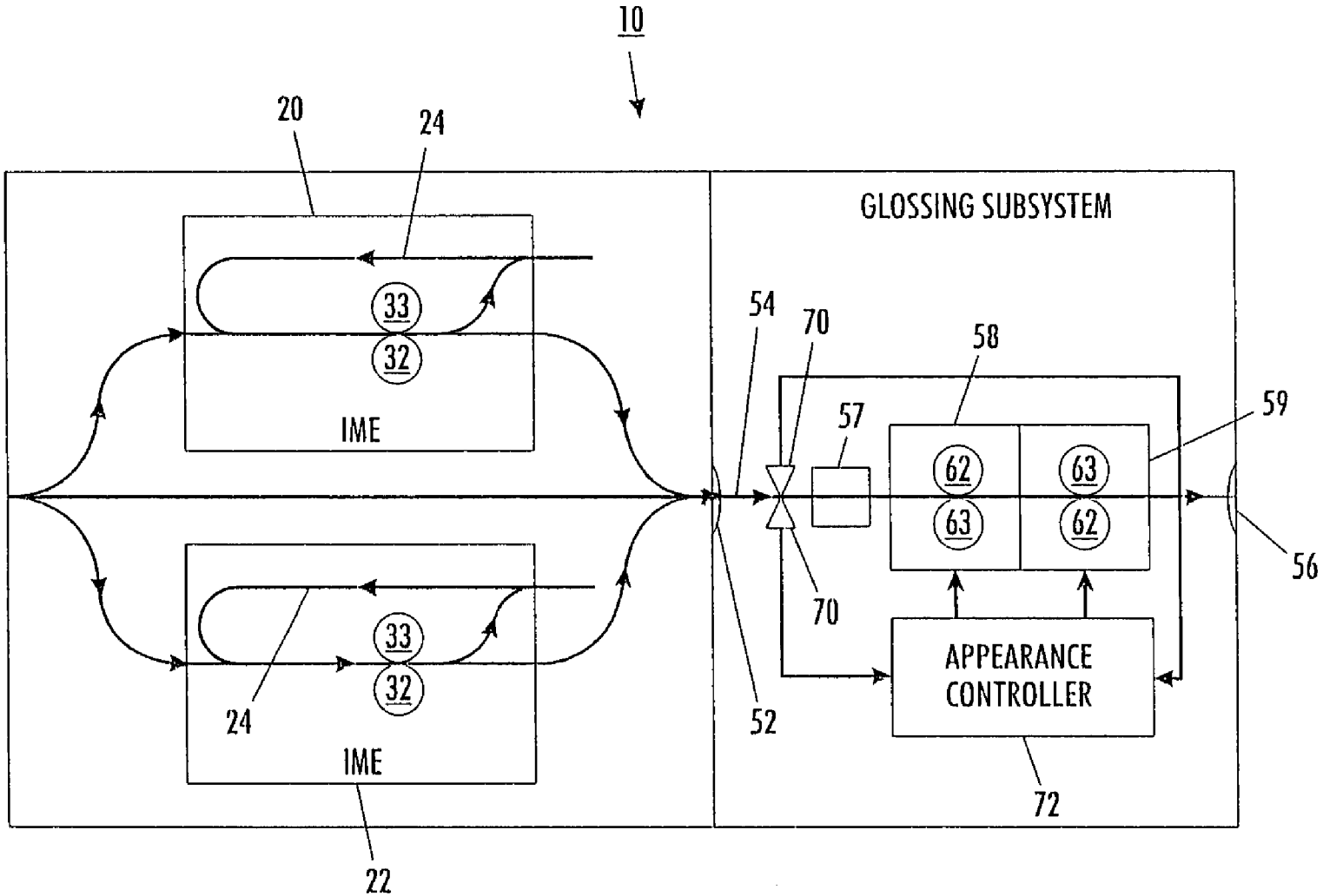
FIG. 2 is a schematic view of the printing device in FIG. 1, showing details of the glossing subsystem.

With reference to FIG. 2, suitably, the IMEs 20 and 22 are duplex IMEs. That is to say, each individual IME is arranged within the printing device 10 so as to selectively print, image or otherwise provide markings on two opposing sides of the same output media, e.g., on the front and back sides of the same sheet of paper. As shown, duplex output is achieved by each IME 20, 22 via a duplex media handling path 24 that is used to invert media being transported through the IMEs and/or the printing device 10.

For example, during a first pass, a first side of the media is marked by an IME. That is to say, the first side receives the toner or other marking agent at the IME's 20, 22 transfer station 38 and then passes through the IME's fusing station 31 with the first side facing the fuser 32. Subsequently, after having been inverted via the duplex media handling path 24, the same media is transported a second time through the IME 20, 22 this time with the second side receiving the toner or other marking agent at the IME's transfer station 38 and passing through the IME's fusing station 31 with the second side facing the fuser 32. Accordingly, the media output from the IME 20, 22 is printed or otherwise marked on both sides, suitably, prior to being received at the glossing subsystem 50. Alternately, duplex output from the IMEs may be achieved in any customary manner.

Optionally, as shown, each IME 20, 22 has its own duplex media handling path 24. However, it is to be appreciated that a common duplex media handling path may alternately be used to invert the media for multiple IMEs. In another alternate embodiment, duplex output is optionally achieved using two simplex IMEs which each prints on or otherwise marks opposite sides of the same output media. In any event, suitably, the media output from the IMEs is printed, imaged or otherwise marked on both sides (i.e., duplexed) before being received by the glossing subsystem 50.

As shown, the glossing subsystem 50 receives input media from the IMEs 20, 22 at the media receiving or input port 52. The received media is transported along a media handling path 54 that passes through a plurality of glossing units to a media output port 56. Optionally, before reaching the glossing units the media is pre-heated by an appropriate heating unit 57 so as to minimize or reduce the temperature that would otherwise be supplied at the glossing units. Suitably, the glossing subsystem 50 includes a pair glossing units, namely, a first glossing unit 58 and a second glossing unit 59. In the illustrated embodiment, each glossing unit includes a glosser 62 and a pressure roll 63. Suitably, the glosser 62 takes the form of a roll that is heated by a heating element (not shown). When the media moves between the two rollers 62 and 63, the pressure roller 63 presses the output media against the glosser 62. Accordingly, the heat of the glosser 62 and pressure applied by the pressure roller 63 completes any incomplete fixing and/or fusing of the toner or other marking agent to the media and provides the desired level of glossing.

Suitably, as is understood in the art, the glossing procedure is only responsible for melting a top or outer layer of the toner and changing or smoothing out its surface roughness. Nevertheless, some conformance at the nip between the glosser 62 and the pressure roll 63 is desirable in order to achieve contact with all areas of the image deposited on the media. Accordingly, the pressure roll 63 is optionally made or formed from a suitably durable yet sufficiently conformable material. For example, the pressure roll 63 is optionally an elastomer or perfluoroalkoxy (PEA) sleeve over a conformable elastomer. In this manner, the glosser (gloss roll) 62 can then be made substantially hard and/or rigid with a durable material such as a ceramic coating or the like. Alternately, the configuration of and/or materials used to implemented the pressure roll 63 and/or glosser 62 are any that are customary employed for the intended purpose.

As one can appreciate from FIG. 2, the respective orientations of the glosser 62 and pressure roll 63 in the second glossing unit 59 are reversed with respect to the media handling path 54 as compared to their orientations in the first glossing unit 58. Accordingly, the first glossing unit 58 applies the desired level of gloss to a first side of the received duplex media (i.e., the side facing the glosser 62 in the first glossing unit 58), while the second glossing unit 59 applies the desired level of gloss to a second side (opposite the first side) of the received duplex media (i.e., the side facing the glosser 62 in the second glossing unit 59). In this manner, both sides of the duplexed media received by the glossing subsystem 50 are glossed to a desired level, suitably, without being inverted therebetween.

Optionally, the glossing subsystem 50 is equipped with a gloss calibration and/or control system. Suitably, the gloss calibration/control system includes a pair of sensors 70 that monitor the gloss levels on both sides of the incoming duplexed media (i.e., one sensor 70 for each side). As shown, the sensors 70 communicate the detected gloss levels to an appearance controller 72, e.g., via an appropriate signal or otherwise. In response to the gloss levels detected by the sensors 70, the appearance controller 72 regulates the operating conditions (e.g., temperature and/or pressure) applied in the respective glossing units 58 and 59 so that the final appearance of the media output from the glossing subsystem 50 achieves a target level. In this manner, a uniform gloss can be sufficiently maintained as between the two sides of the duplexed media and/or as between media received from different IMEs. Additionally, the target gloss level is optionally set by a user via a user interface or other like mechanism. Accordingly, the final appearance or gloss level may be readily chosen as desired for a particular job or application. Optionally, if desired, different sides of the duplexed media may be set to different gloss levels without altering the operating conditions of either of the glossing units as each side of the media is glossed by a separate glossing unit.

In the disclosed embodiments "at least one" refers, for example, to 1 or more than 1, and "multiple" or a "plurality" refers, for example, to 2 or more than 2.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing device comprising:

a plurality of marking engines that selectively place marks on an output media having opposing first and second sides using a marking agent deposited on the output media, each marking engine including a fuser that at least temporarily fixes the marking agent to the output media; and, a glossing subsystem that receives marked output media from the marking engines, said glossing subsystem including a first glossing unit that selectively provides a gloss level to the first side of the received output media and a second glossing unit that selectively provides a gloss level to the second side of the received output media.

2. The printing device of claim 1, wherein the plurality of marking engines are two marking engines.

3. The printing device of claim 1, wherein each of the plurality of marking engines is arranged to selectively mark the output media on both the first and second sides thereof.

4. The printing device of claim 1, wherein the marking engines are xerographic or solid ink printing modules.

5. The printing device of claim 1, wherein the glossing subsystem further includes:

a media handling path along which the received output media is transported successively through the first and second glossing units without the media being inverted therebetween.

6. The printing device of claim 1, wherein the glossing subsystem further includes:

a heating unit that pre-heats the output media received by the glossing subsystem prior to the media reaching the glossing units.

7. The printing device of claim 1, wherein the glossing subsystem further includes:

a first sensor that detects a gloss level on the first side of the output media being received by the glossing subsystem prior to the media reaching the first glossing unit;

a second sensor that detects a gloss level on the second side of the output media being received by the glossing subsystem prior to the media reaching the second glossing unit; and, a controller in operative communication with the first and second sensors, said controller regulating the operating conditions of the first and second glossing units, respectively, in response to the gloss levels detected by the first and second sensors, such that target gloss levels on the first and second sides of the media are achieved by the first and second glossing units.

8. A xerographic imaging device comprising:

a first integrated marking engine, said first integrated marking engine selectively putting marks on an output media with a marking agent;

a second integrated marking engine, said second integrated marking engine selectively putting marks on an output media with a marking agent; and, a glossing subsystem that receives marked output media from the first and second integrated marking engines, said glossing subsystem including a first glossing unit that selectively provides a gloss level to a first side of the received output media and a second glossing unit that selectively provides a gloss level to a second side of the received output media, said second side being opposite the first side.

9. The xerographic imaging device of claim 8, wherein the first and second integrated marking engines are xerographic modules including fusers.

10. The xerographic imaging device of claim 8, wherein the first and second integrated marking engines are arranged to selectively mark the output media on both the first and second sides thereof.

11. The xerographic imaging device of claim 8, wherein the glossing subsystem further includes:

a media handling path along which the received output media is transported successively through the first and second glossing units without the media being inverted therebetween.

12. The xerographic imaging device of claim 8, wherein the glossing subsystem further includes:

a heating unit that pre-heats the output media received by the glossing subsystem prior to the media reaching the glossing units.

13. The xerographic imaging device of claim 12, wherein each glossing unit includes:

a heated gloss roller that faces the side of the media being glossed by that glossing unit; and, a pressure roller that presses the media against the heated gloss roller as it is being transported through the glossing unit.

14. The xerographic imaging device of claim 8, wherein the glossing subsystem further includes:

at least one sensor that detects a gloss level on at least one side of the output media being received by the glossing subsystem prior to the media reaching at least one of the glossing units; and, a controller in operative communication with the at least one sensor, said controller regulating the operating conditions of at least one of the glossing units in response to the gloss level detected by the at least one sensor, such that a target gloss level is achieved on at least one of the first and second sides of the media by the at least one glossing unit.

15. A glossing subsystem that receives duplexed output media that has been selectively marked on a first side and a second side, said glossing subsystem comprising:

a first glossing unit that selectively provides a first gloss level to a first side of the duplexed output media;

a second glossing unit that selectively provides a second gloss level to a second side of the duplexed output media; and, a heating unit that pre-heats the output media received by the glossing subsystem prior to the media reaching the glossing units.

16. A glossing subsystem that receives duplexed output media that has been selectively marked on a first side and a second side, said glossing subsystem comprising:

a first glossing unit that selectively provides a first gloss level to a first side of the duplexed output media;

a second glossing unit that selectively provides a second gloss level to a second side of the duplexed output media;

at least one sensor that detects a gloss level on at least one side of the output media being received by the glossing subsystem prior to the media reaching at least one of the glossing units; and, a controller in operative communication with the at least one sensor, said controller regulating the operating conditions of at least one of the glossing units in response to the gloss level detected by the at least one sensor, such that a target gloss level is achieved on at least one of the first and second sides of the media by the at least one glossing unit.

17. A printing device incorporating a glossing subsystem that receives duplexed output media that has been selectively marked on a first side and a second side, said glossing subsystem comprising:

a first glossing unit that selectively provides a first gloss level to a first side of the duplexed output media; and, a second glossing unit that selectively provides a second gloss level to a second side of the duplexed output media;

wherein the printing device produces the duplexed output media received by the glossing subsystem and includes a plurality of marking engines that selectively place marks on the duplex output media using a marking agent deposited thereon.

* * * * *